US011254542B2

(12) United States Patent
Tracey et al.

(10) Patent No.: US 11,254,542 B2
(45) **Date of Patent: *Feb. 22, 2022**

(54) CAR DOOR INTERLOCK

(71) Applicant: OTIS ELEVATOR COMPANY, Farmington, CT (US)

(72) Inventors: Michael J. Tracey, Cromwell, CT (US); Richard E. Kulak, Niantic, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 430 days.

This patent is subject to a terminal disclaimer.

(21) Appl. No.: 16/105,360

(22) Filed: Aug. 20, 2018

(65) Prior Publication Data

US 2020/0055705 A1 Feb. 20, 2020

(51) Int. Cl.
*B66B 13/20* (2006.01)
*B66B 13/12* (2006.01)

(52) U.S. Cl.
CPC ..... *B66B 13/20* (2013.01); *B66B 13/12* (2013.01)

(58) Field of Classification Search
CPC ..... B66B 13/12; B66B 13/18; B66B 13/20
See application file for complete search history.

(56) References Cited

U.S. PATENT DOCUMENTS 3,913,270 A 10/1975 Kumagai
4,926,974 A 5/1990 Morris et al.
4,926,975 A 5/1990 Morris
4,947,964 A * 8/1990 Husmann ..... B66B 13/12 187/319
5,636,715 A 6/1997 Hayashi et al.
5,651,428 A 7/1997 Ahigian et al.
5,819,877 A 10/1998 Rivera et al.
6,220,396 B1 4/2001 Heath, III
6,446,759 B1 9/2002 Kulak et al.
7,252,179 B2 8/2007 Oberleitner
(Continued)

FOREIGN PATENT DOCUMENTS

CN 1323022 C 6/2007
CN 101663224 A 3/2010
(Continued)

OTHER PUBLICATIONS

Machine Translation of WO 2017/031829.*
(Continued)

*Primary Examiner* — Diem M Tran
(74) *Attorney, Agent, or Firm* — Cantor Colburn LLP

(57) ABSTRACT

An elevator car door interlock includes a first link assembly and a latch assembly. The first link assembly includes a first intermediate link and a first link. The first intermediate link is movably connected to a first sensing vane. The first link is pivotally connected to a baseplate. The first link has a first link first arm pivotally connected to the first intermediate link, and a first link second arm having a first link first connection that is pivotally connected to a second sensing vane. The latch assembly includes a lock member, a door latch, and a latch link. The door latch is pivotally connected to the baseplate and is arranged to selectively engage the lock member. The latch link extends between and is pivotally connected to the door latch and the first intermediate link.

16 Claims, 7 Drawing Sheets

(56) References Cited

U.S. PATENT DOCUMENTS

| | | | | |
|---|---|---|---|---|
| 7,350,623 | B2 | 4/2008 | Kinoshita et al. | |
| 7,370,731 | B2 * | 5/2008 | Cocher | B66B 13/20 187/330 |
| 7,388,962 | B2 | 7/2008 | Dziwak | |
| 7,398,862 | B2 | 7/2008 | Dziwak | |
| 7,464,794 | B2 | 12/2008 | Badaoui et al. | |
| 8,960,372 | B2 | 2/2015 | Heath et al. | |
| 9,656,835 | B2 | 5/2017 | Kitazawa | |
| 9,688,515 | B2 | 6/2017 | MacAreno et al. | |
| 2005/0139429 | A1 * | 6/2005 | Bisang | B66B 13/12 187/319 |
| 2005/0145442 | A1 * | 7/2005 | Cocher | B66B 13/20 187/333 |
| 2006/0107785 | A1 * | 5/2006 | Zappa | B66B 13/20 74/612 |
| 2006/0225966 | A1 | 10/2006 | Cocher | |
| 2007/0295564 | A1 | 12/2007 | Someya | |
| 2011/0186386 | A1 * | 8/2011 | Gilli | B66B 13/12 187/324 |
| 2012/0298453 | A1 | 11/2012 | Fujii et al. | |
| 2017/0217732 | A1 | 8/2017 | Kitazawa | |
| 2018/0186606 | A1 | 7/2018 | Rhouzlane et al. | |
| 2020/0122978 | A1 | 4/2020 | Tracey et al. | |

FOREIGN PATENT DOCUMENTS

| | | | | |
|---|---|---|---|---|
| CN | 102041044 | A | 5/2011 | |
| CN | 201864431 | U | 6/2011 | |
| CN | 202897753 | U | 4/2013 | |
| CN | 102398833 | B | 11/2013 | |
| CN | 102642758 | B | 12/2013 | |
| CN | 103562116 | A | 2/2014 | |
| CN | 204224051 | U | 3/2015 | |
| CN | 204281004 | U | 4/2015 | |
| CN | 204549769 | U | 8/2015 | |
| CN | 204938677 | U | 1/2016 | |
| CN | 204958087 | U | 1/2016 | |
| CN | 105565126 | A | 5/2016 | |
| CN | 205222393 | U | 5/2016 | |
| CN | 104555673 | B | 8/2016 | |
| CN | 105967029 | A | 9/2016 | |
| CN | 205973392 | U | 2/2017 | |
| CN | 106687405 | A | 5/2017 | |
| CN | 106744199 | A | 5/2017 | |
| CN | 107010519 | A | 8/2017 | |
| CN | 105731229 | B | 9/2017 | |
| CN | 206562251 | U | 10/2017 | |
| CN | 107381305 | A | 11/2017 | |
| CN | 107848763 | A | 3/2018 | |
| CN | 207226777 | U | 4/2018 | |
| CN | 107973200 | A | 5/2018 | |
| CN | 207404666 | U | 5/2018 | |
| EP | 0164581 | A1 | 12/1985 | |
| EP | 2168902 | A1 | 3/2010 | |
| EP | 2157040 | B1 | 1/2015 | |
| GB | 962422 | A | 7/1964 | |
| JP | S4920420 | B1 | 5/1974 | |
| WO | 03089356 | A1 | 10/2003 | |
| WO | WO-2008149456 | A1 * | 12/2008 | B66B 13/12 |
| WO | 2017023927 | A1 | 2/2017 | |
| WO | 2017031829 | A1 | 3/2017 | |

OTHER PUBLICATIONS

Machine Translation of WO 2008/149456.*

European Search Report for Application No. 19192683.1; dated Jul. 24, 2020; 8 Pages.

European Search Report for Application No. 19203934.5; dated Jul. 13, 2020; 7 Pages.

U.S. Non-Final Office Action for U.S. Appl. No. 16/163,003; dated Nov. 23, 2020; 28 Pages.

Chinese Office Action for Application No. 201910764016.2; dated Jun. 28, 2021; 7 Pages.

Chinese Office Action for Application No. 201910982789.8; dated Sep. 3, 2021; 9 Pages.

* cited by examiner

CAR DOOR INTERLOCK

BACKGROUND

The embodiments herein relate to elevator car door interlocks.

Elevators or lift installations are arranged to move between landings of a multi-floor building. Elevators or lift installations are provided with sliding doors that are disposed on elevator car that are to remain closed during movement of the elevator between landings. Elevator codes require that the elevator car doors be provided with devices that inhibit the opening of the elevator car doors between landings and to facilitate opening of the elevator car doors at the landings. The elevator codes may also require a maximum gap between the elevator car doors when a force is applied.

BRIEF SUMMARY

According to an embodiment, an elevator car door interlock is disclosed. The elevator car door interlock includes a baseplate, a first sensing vane, a second sensing vane, a first link assembly, and a latch assembly. The first link assembly includes a first intermediate link and a first link. The first intermediate link is movably connected to the first sensing vane. The first link is pivotally connected to the baseplate. The first link has a first link first arm pivotally connected to the first intermediate link, and a first link second arm having a first link first connection that is pivotally connected to the second sensing vane. The latch assembly includes a door latch pivotally connected to the baseplate and arranged to selectively engage a lock member, and a latch link extending between and pivotally connected to the door latch and the first intermediate link.

In addition to one or more of the features described herein, or as an alternative, further embodiments include a pawl having a first pawl end pivotally connected to the baseplate and a second pawl end pivotally connected to a first link second connection of the first link.

In addition to one or more of the features described herein, or as an alternative, further embodiments include a pawl guide defining a ramp that is disposed proximate an end of the baseplate.

In addition to one or more of the features described herein, or as an alternative, further embodiments include a rod that extends from a pawl arm that is disposed proximate the second pawl end.

In addition to one or more of the features described herein, or as an alternative, responsive to a first interlock roller engaging the first sensing vane and a second interlock roller engaging the second sensing vane, the first intermediate link moves relative to the first sensing vane, such that the latch link moves the door latch to disengage from the lock member to enable an elevator car door to move between a door open position and a door closed position.

In addition to one or more of the features described herein, or as an alternative, responsive to the elevator car door moving between the door open position and the door closed position, the first link pivots to move at least one of the first sensing vane and the second sensing vane relative to the baseplate.

In addition to one or more of the features described herein, or as an alternative, responsive to the car door moving between the door open position and the door closed position, the pawl maintains a position of the first link relative to the baseplate.

In addition to one or more of the features described herein, or as an alternative, responsive to the car door moving from the open position towards the closed position, the rod rides along the ramp and the latch link moves the latch link to engage the lock member to inhibit the car door from moving away from the closed position.

In addition to one or more of the features described herein, or as an alternative, further embodiments include a biasing member extending between the baseplate and at least one of the lock member and the door latch.

In addition to one or more of the features described herein, or as an alternative, responsive to a first interlock roller engaging the first sensing vane and a second interlock roller engaging the second sensing vane, the biasing member moves the second sensing vane relative to the baseplate and moves the door latch to disengage from the lock member to enable an elevator car door to move between a door open position and a door closed position.

According to another embodiment, an elevator car door interlock is disclosed. The elevator car door interlock includes a first link assembly and a latch assembly. The first link assembly includes a first intermediate link and a first link. The first intermediate link is movably connected to a first sensing vane. The first link is pivotally connected to a baseplate. The first link has a first link first arm pivotally connected to the first intermediate link, and a first link second arm having a first link first connection that is pivotally connected to a second sensing vane. The latch assembly includes a lock member, a door latch, and a latch link. The door latch is pivotally connected to the baseplate and is arranged to selectively engage the lock member. The latch link extends between and is pivotally connected to the door latch and the first intermediate link.

In addition to one or more of the features described herein, or as an alternative, the first sensing vane defines a first slot that receives a first pin of the first intermediate link.

In addition to one or more of the features described herein, or as an alternative, further embodiments include a second link assembly pivotally connected to the baseplate and spaced apart from the first link assembly. The second link assembly includes a second intermediate link and a second link. The second intermediate link is movably connected to the first sensing vane. The second link is pivotally connected to the baseplate. The second link has a second link first arm pivotally connected to the second intermediate link, and a second link second arm having a second link first connection that is pivotally connected to the second sensing vane.

In addition to one or more of the features described herein, or as an alternative, the first sensing vane defines a second slot that receives a second pin of the second intermediate link.

In addition to one or more of the features described herein, or as an alternative, further embodiments include a pawl having a first pawl end pivotally connected to the baseplate and a second pawl end pivotally connected to a first link second connection of the first link.

In addition to one or more of the features described herein, or as an alternative, responsive to an attempt to move an elevator car door between a door closed position and a door open position while a first interlock roller being spaced apart from the first sensing vane and a second interlock roller being spaced apart from the second sensing vane, the pawl pivots relative to the baseplate, the first link and the second link move the second sensing vane relative to the first sensing vane, and the door latch is inhibited from disengaging from the lock member.

In addition to one or more of the features described herein, or as an alternative, responsive to a first interlock roller engaging the first sensing vane and a second interlock roller engaging the second sensing vane, the first pin of the first intermediate link moves between a first slot first end and a first slot second end.

In addition to one or more of the features described herein, or as an alternative, responsive to the first interlock roller engaging the first sensing vane and the second interlock roller engaging the second sensing vane, the second pin of the second intermediate link moves between a second slot first end and a second slot second end.

In addition to one or more of the features described herein, or as an alternative, further embodiments include a belt drive drivably connected to the first link through a pin.

In addition to one or more of the features described herein, or as an alternative, responsive to a first interlock roller engaging the first sensing vane and a second interlock roller engaging the second sensing vane and responsive to the belt drive pivoting the first link, the first intermediate link moves relative to the first sensing vane, such that the latch link moves the door latch to disengage from the lock member to enable an elevator car door to move between a door closed position and a door open position.

Technical effects of embodiments of the present disclosure include responsive to a first interlock roller engaging a first sensing vane and a second interlock roller engaging a second sensing vane, a first intermediate link moves relative to the first sensing vane, such that a latch link moves a door latch to disengage from a lock member to enable an elevator car door to move between a door closed position and a door open position.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
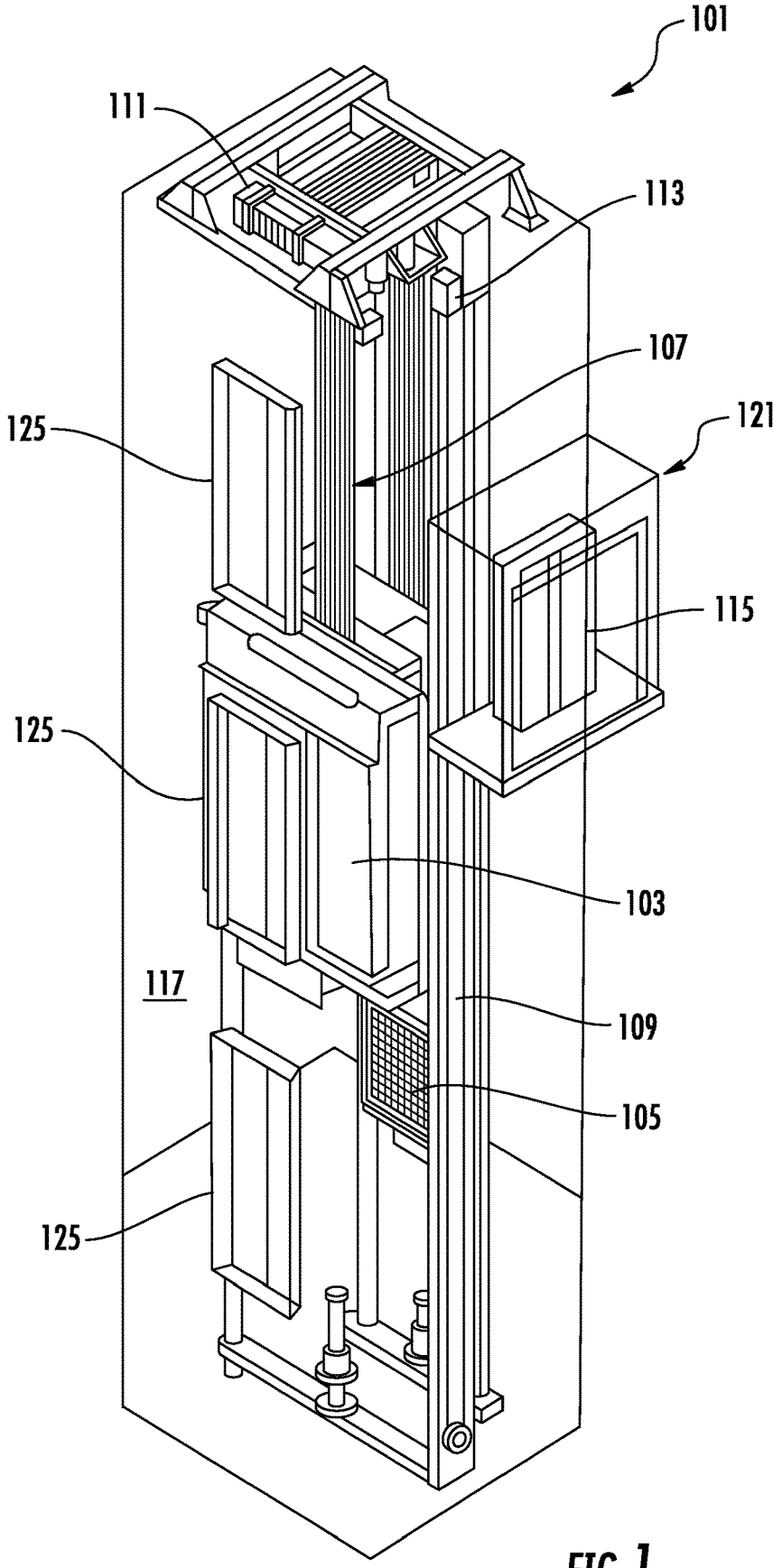
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within a hoistway or an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
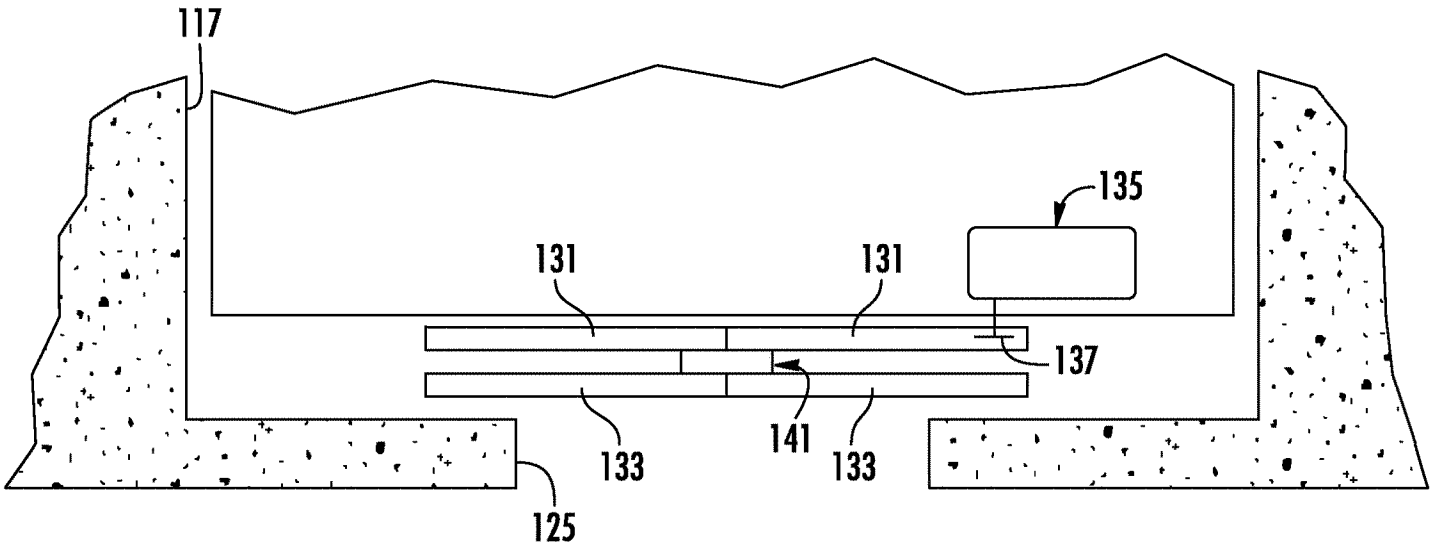
FIG. 2 is a plan view of an elevator car in an elevator shaft while the elevator car doors and the landing doors are in a closed position and a car door interlock in a locked position.
Figure 3:
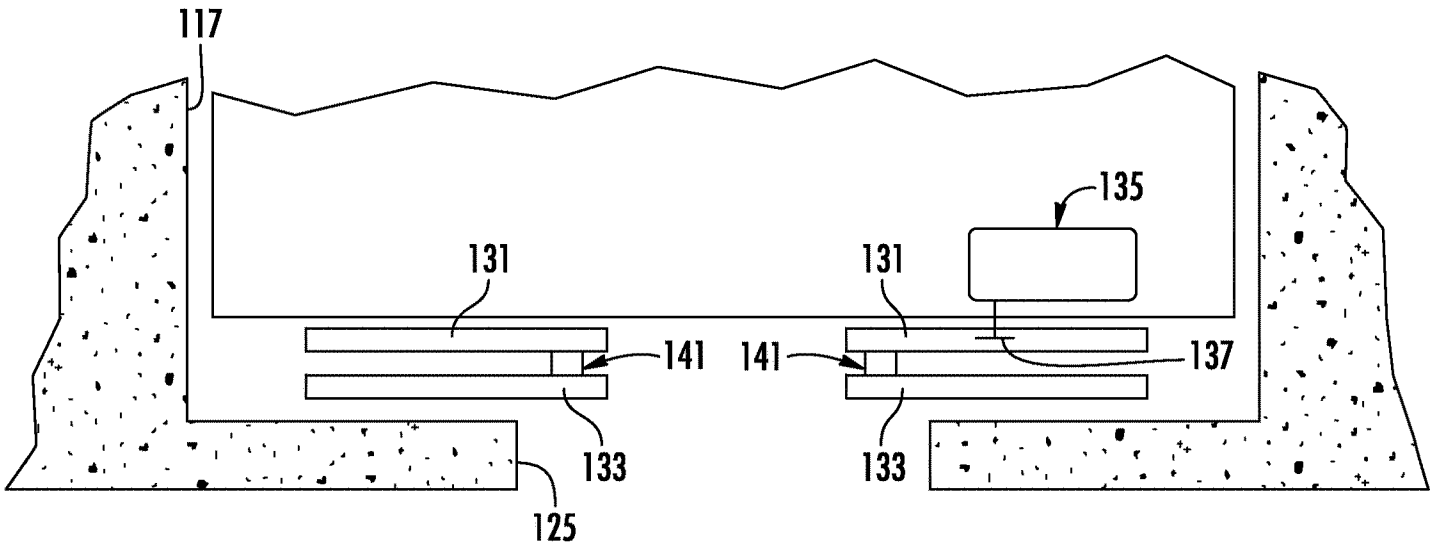
FIG. 3 is a plan view of an elevator car in an elevator shaft while the elevator car doors and the landing doors are in an open position and the car door interlock in an unlocked position.

Referring to FIGS. 2 and 3, the elevator car 103 of the elevator system 101 is shown in plan view within the elevator shaft 117. The elevator car 103 includes a pair of movable elevator car doors 131 and correspondence with movable landing doors 133. The elevator car doors 131 and/or the movable landing doors 133 are moved between a closed position, as shown in FIG. 2, and an open position, as shown in FIG. 3, by a drive mechanism 135 having a belt drive 137. The elevator car doors 131 are inhibited from moving between the closed position and the open position when the elevator car 103 is between landings 125 by a car door interlock 141 that is operatively connected to the elevator car doors 131. The elevator car doors 131 are enabled to move between the closed position and the open position by the car door interlock 141 while the elevator car 103 is at a landing 125 or within a landing zone/unlocking zone.

Figure 4:
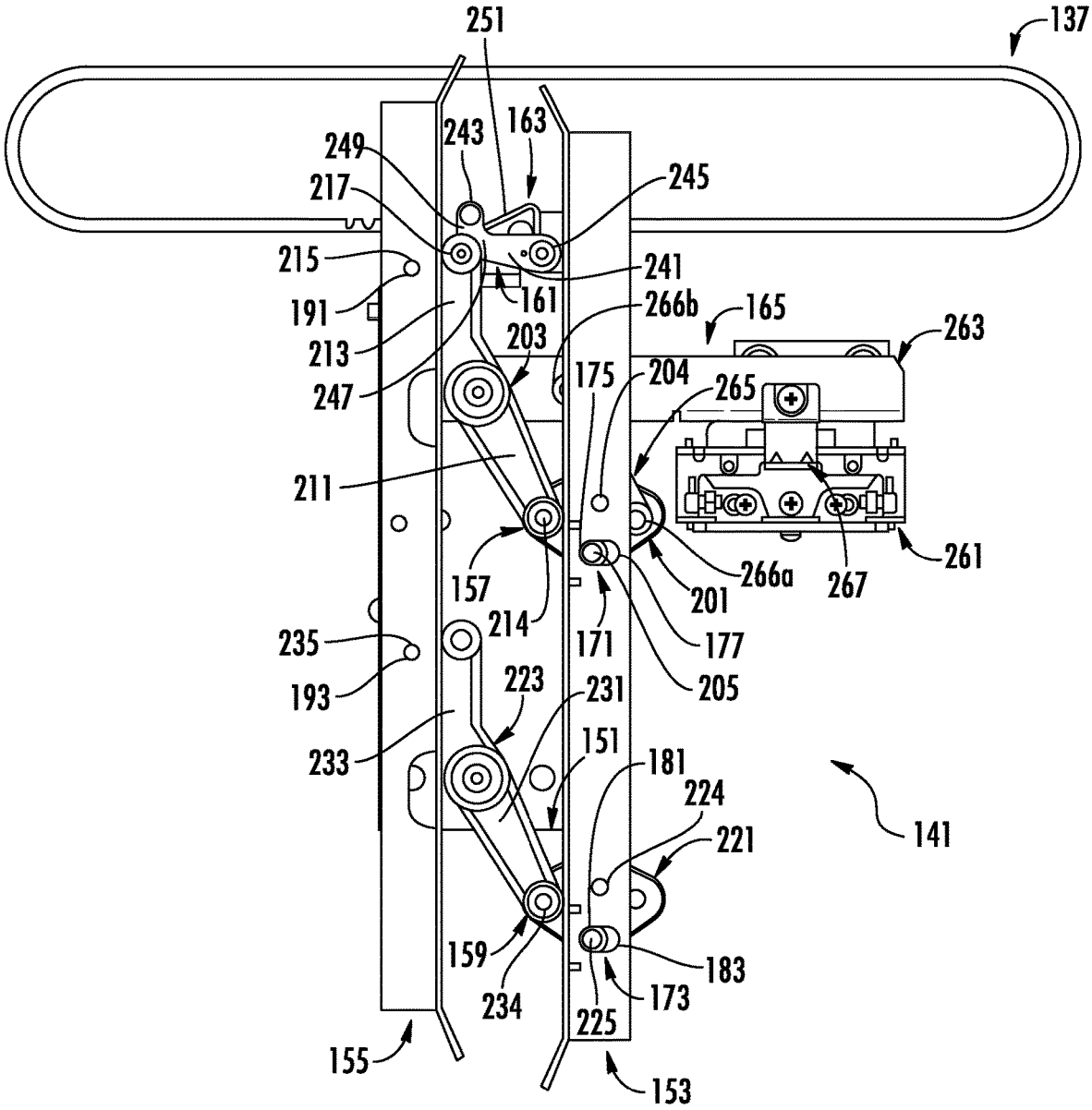
FIG. 4 is a perspective view of the car door interlock.

Referring to FIG. 4, the car door interlock 141 includes a baseplate 151, a first sensing vane 153, a second sensing vane 155, a first link assembly 157, a second link assembly 159, a pawl assembly 161, a pawl guide 163, and a latch assembly 165.

The baseplate 151 may be disposed on an elevator car door 131. The first sensing vane 153 and the second sensing vane 155 are movably disposed on the baseplate 151 relative to each other.

The first sensing vane 153 extends along a vertical axis that is disposed parallel to the direction of travel of the elevator car 103. The first sensing vane 153 defines a first slot 171 and a second slot 173. The first slot 171 is a generally elongated slot that extends between a first slot first end 175 and a first slot second end 177 along a horizontal axis. The second slot 173 is axially spaced apart from the first slot 171 along the vertical axis. The second slot 173 is a generally elongated slot that extends between a second slot first end 181 and a second slot second end 183 along the horizontal axis. The first sensing vane 153 is arranged to actuate the latch assembly 165 that enables the elevator car doors 131 to move between the closed position and the open position, while the elevator car 103 is at the landing 125.

The second sensing vane 155 is spaced apart from the first sensing vane 153. The second sensing vane 155 extends along a vertical axis that is disposed parallel to the direction of travel of the elevator car 103. The second sensing vane 155 defines a first pivot 191 and a second pivot 193 that is axially spaced apart from the first pivot 191 along the vertical axis.

The first link assembly 157 includes a first intermediate link 201 and a first link 203. The first intermediate link 201 is movably connected to the first sensing vane 153 through a first pivot pin 204 and a first pin 205. The first pivot pin 204 extends into the first sensing vane 153. The first pin 205 extends into the first slot 171. The first pin 205 facilitates the first intermediate link 201 moving along the horizontal axis between the first slot first end 175 and the first slot second end 177 and facilitates the pivoting or rotating of the first intermediate link 201 relative to the first sensing vane 153.

The first link 203 is pivotally connected to the baseplate 151. The first link 203 extends between the first intermediate link 201 and the second sensing vane 155. The first link 203 includes a first link first arm 211 and a first link second arm 213. The first link first arm 211 is pivotally connected to the first intermediate link 201 through a first pivot 214. The first link second arm 213 includes a first link first connection 215 and a first link second connection 217, each may be arranged as pins. The first link first connection 215 extends into the first pivot 191 to pivotally connect the first link second arm 213 to the second sensing vane 155. The first link second connection 217 is connected to a pawl of the pawl assembly 161 and is connected to the drive belt 137, through a belt hitch, such that operation of the drive belt 137 drives or pivots the first link 203 of the first link assembly 157 and the second link assembly 159 to move the first sensing vane 153 and the second sensing vane 155 relative to each other to move between an open position and a closed position.

The second link assembly 159 includes a second intermediate link 221 and a second link 223. The second intermediate link 221 is movably connected to the first sensing vane 153 through a second pivot pin 224 and a second pin 225. The second pivot pin 224 extends into the first sensing vane 153. The second pin 225 extends into the second slot 173. The second pin 225 facilitates the second intermediate link 221 moving along the horizontal axis between the second slot first end 181 and the second slot second end 183 and facilitates the pivoting or rotating of the second intermediate link 221 relative to the first sensing vane 153 and/or the baseplate 151.

The second link 223 is pivotally connected to the baseplate 151. The second link 223 extends between the second intermediate link 221 and the second sensing vane 155. The second link 223 includes a second link first arm 231 and a second link second arm 233. The second link first arm 231 is pivotally connected to the second intermediate link 221 through a second pivot 234. The second link second arm 233 includes a second link first connection 235 that extends into the second pivot 193 to pivotally connect the second link second arm 233 to the second sensing vane 155. The second link first connection 235 may be a pin.

The pawl assembly 161 includes a pawl 241 and a rod 243 that extends from the pawl 241. The pawl 241 includes a first pawl end 245, a second pawl end 247, and a pawl arm 249. The first pawl end 245 is pivotally connected to the baseplate 151. The pawl 241 is arranged to rotate about the first pawl end 245 to lock and unlock the first link 203 at the first link second connection 217. The pawl 241 is a latching member that prevents the belt drive 137 from back driving the link assemblies 157, 159 to move the first and second sensing vanes 153, 155 from moving towards the closed position from the open position. The pawl arm 249 is disposed proximate and extends from the second pawl end 247. The rod 243 extends from the pawl arm 249. The pawl 241 is arranged pivot relative to the baseplate 151 such that a torsion spring provided with the pawl assembly 161 locks the first link 203 of the first link assembly 157 such that the first sensing vane 153 and the second sensing vane 155 remain spaced apart from each other while the elevator car door 131 moves between the open position and the closed position.

The pawl guide 163 is disposed proximate the pawl assembly 161. The belt drive 137 is connected to the first link second connection 217 of the first link 203 such that the first link 203 and/or the second link 223 pivot relative to the baseplate 151 responsive to the operation of the belt drive 137 through the pin 217. The pawl guide 263 is a latching member, wherein movement of the vanes 153, 155 results from the belt connection at the pin 217.

The pawl guide 163 defines a ramp 251 that the rod 243 of the pawl assembly 161 engages. The rod 243 rides along the ramp 251 to unlock the first link 203 of the first link assembly 157 to facilitate the second sensing vane 155 moving relative to the first sensing vane 153.

The latch assembly 165 includes a lock member 261, a door latch 263, and a latch link 265. The lock member 261 may be mounted to the car door header of the elevator car door 131. The lock member 261 defines a slot or a protrusion that is arranged to interface with the door latch 263 to inhibit the elevator car doors 131 from moving from the closed position towards the open position. The lock member 261 includes a switch 267 that is in communication with the controller 115. The switch 267 provides a signal indicative of the elevator car doors 131 being in the closed position, while the door latch 263 engages the lock member 261. The switch 267 provides a signal indicative of the elevator car doors 131 being in the open or unlocked position, while the door latch 263 is disengaged from or spaced apart from the lock member 261.

The door latch 263 is pivotally connected to the baseplate 151. In at least one embodiment, the door latch 263 and the first link 203 share the same pivot with that baseplate 151.

The latch link 265 extends between the door latch 263 and the first intermediate link 201. The latch link 265 is connected to the first intermediate link 201 through a first link pivot 266*a*. The latch link 265 is connected to the door latch 263 through a second link pivot 266*b*. The door latch 263 is arranged to selectively engage the lock member 261 responsive to the latch link 265 pivoting with the first intermediate link 201.

Figure 5:
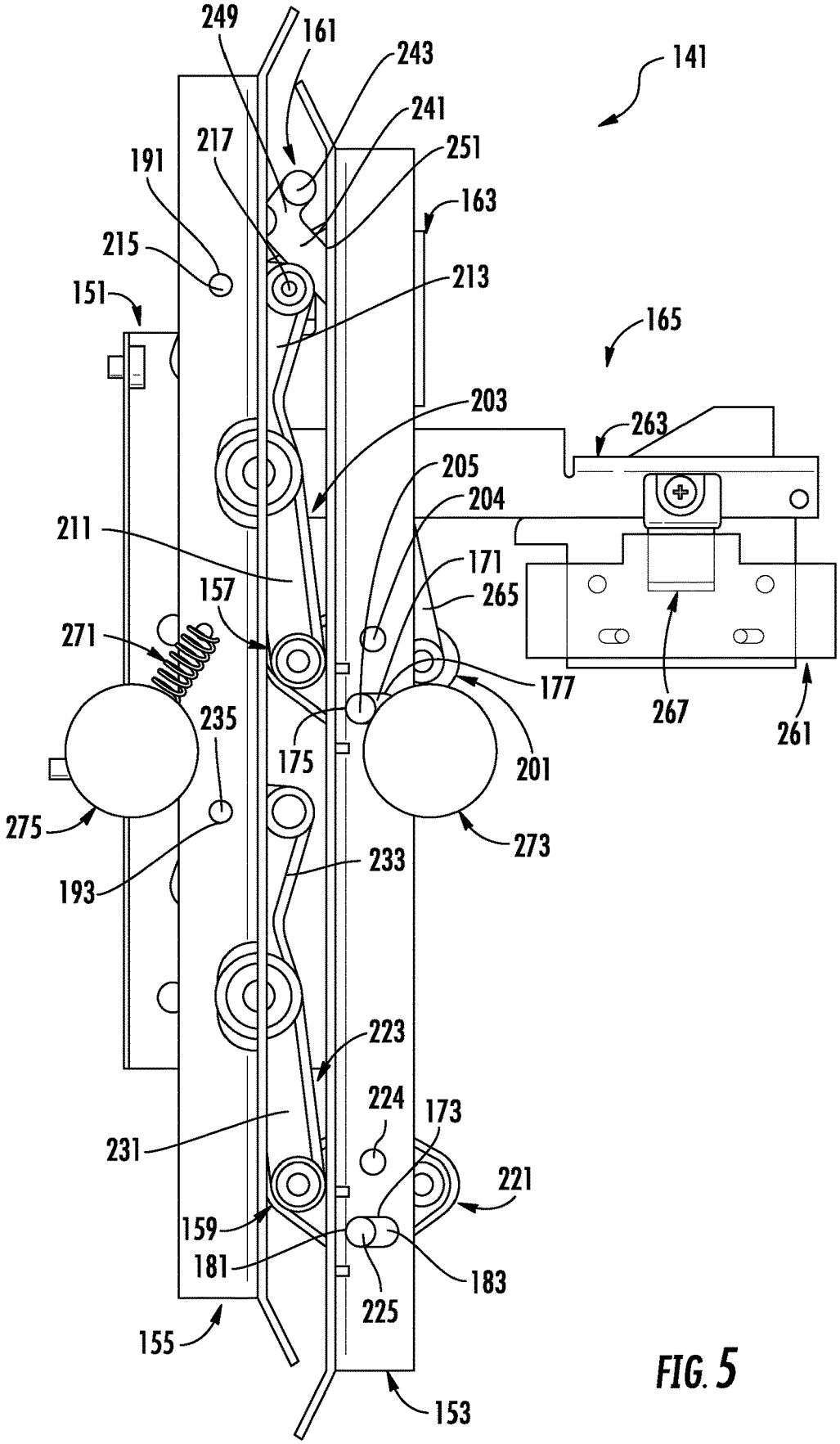
FIG. 5 is a perspective view of the car door interlock in the closed position.
Figure 6:
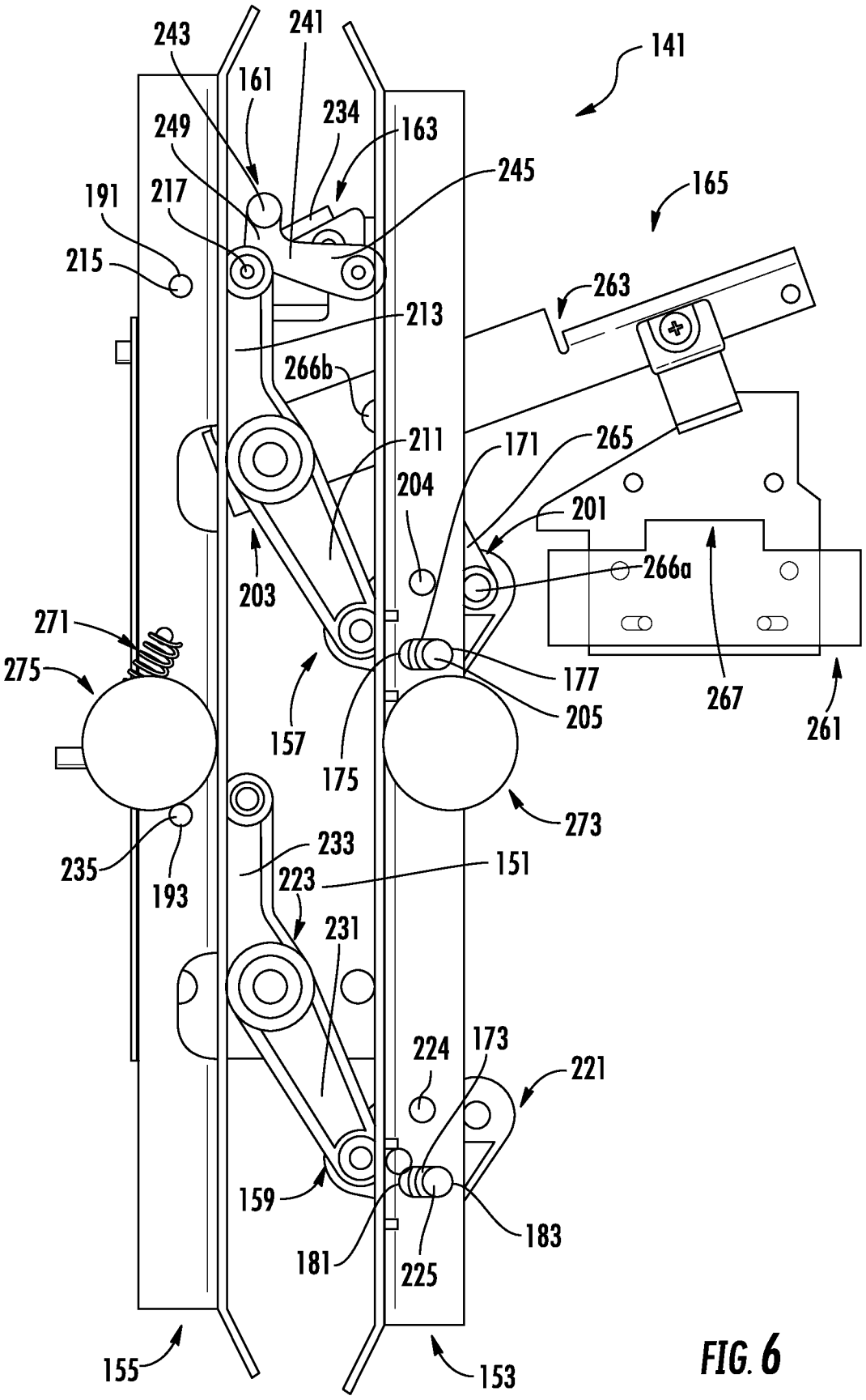
FIG. 6 is a perspective view of the car door interlock in the open position.

Referring to FIGS. 5 and 6, a spring or a biasing member 271 is arranged to open or move the second sensing vane 155 relative to the first sensing vane 153 when power is lost to the elevator car 103 such that a first interlock roller 273 or a second interlock roller 275 engages the first sensing vane 153 and the second sensing vane 155, respectively.

Responsive to the first interlock roller 273 engaging the first sensing vane 153 and the second interlock roller 275 engaging the second sensing vane 155, the first pin 205 of the first intermediate link 201 moves from the first slot first end 175 towards the first slot second end 177 and the second pin 225 of the second intermediate link 221 moves from the second slot first end 181 towards the second slot second end 183 and the biasing member 271 facilitates the pivoting of the latch link 265 via the first intermediate link 201 to unlatch or disengage the door latch 263 from the lock member 261 to enable the elevator car doors 131 to move from the closed position towards the open position.

The first interlock roller 273 and the second interlock roller 275 are associated with a landing 125 or a landing zone/unlocking zone. The first interlock roller 273 and the second interlock roller 275 enable the first sensing vane 153 and the second sensing vane 155 to "sense" when the elevator car 103 is at the landing 125 or within a landing zone/unlocking zone due to the first interlock roller 273 engaging the first sensing vane 153 and the second interlock roller 275 engaging the second sensing vane 155. The biasing member 271 facilitates spacing the first sensing vane 153 apart from the second sensing vane 155 such that the sensing function may be performed.

When the pawl 241 is lifted, the pawl 241 enables the rotation or pivoting of the first link assembly 157 and the second link assembly 159 responsive to the belt drive 137 operating. Then the first and second interlock rollers 273, 275 disengage from the first vane assembly 153 and the second vane assembly 155, respectively, and the first and second intermediate links 215 and 217 move within the first and second slots 171, 173.

Referring to FIG. 5, responsive to the elevator car door 131 moving between the door open position and the door closed position, the rod 243 of the pawl assembly 161 rides along the ramp 251 of the pawl guide 163 to unlock the pawl 241 and pivot the first intermediate link 201 such that the latch link 265 moves the door latch 263 to engage the lock member 261 to inhibit the elevator car door 131 from moving away from the closed position.

Referring to FIG. 6, responsive to the elevator car door 131 moving between the door closed position and the door open position, the pawl 241 is arranged to maintain a position of the first link 203 relative to the baseplate 151 such that the first sensing vane 153 remains a predetermined distance from the second sensing vane 155.

Figure 7:
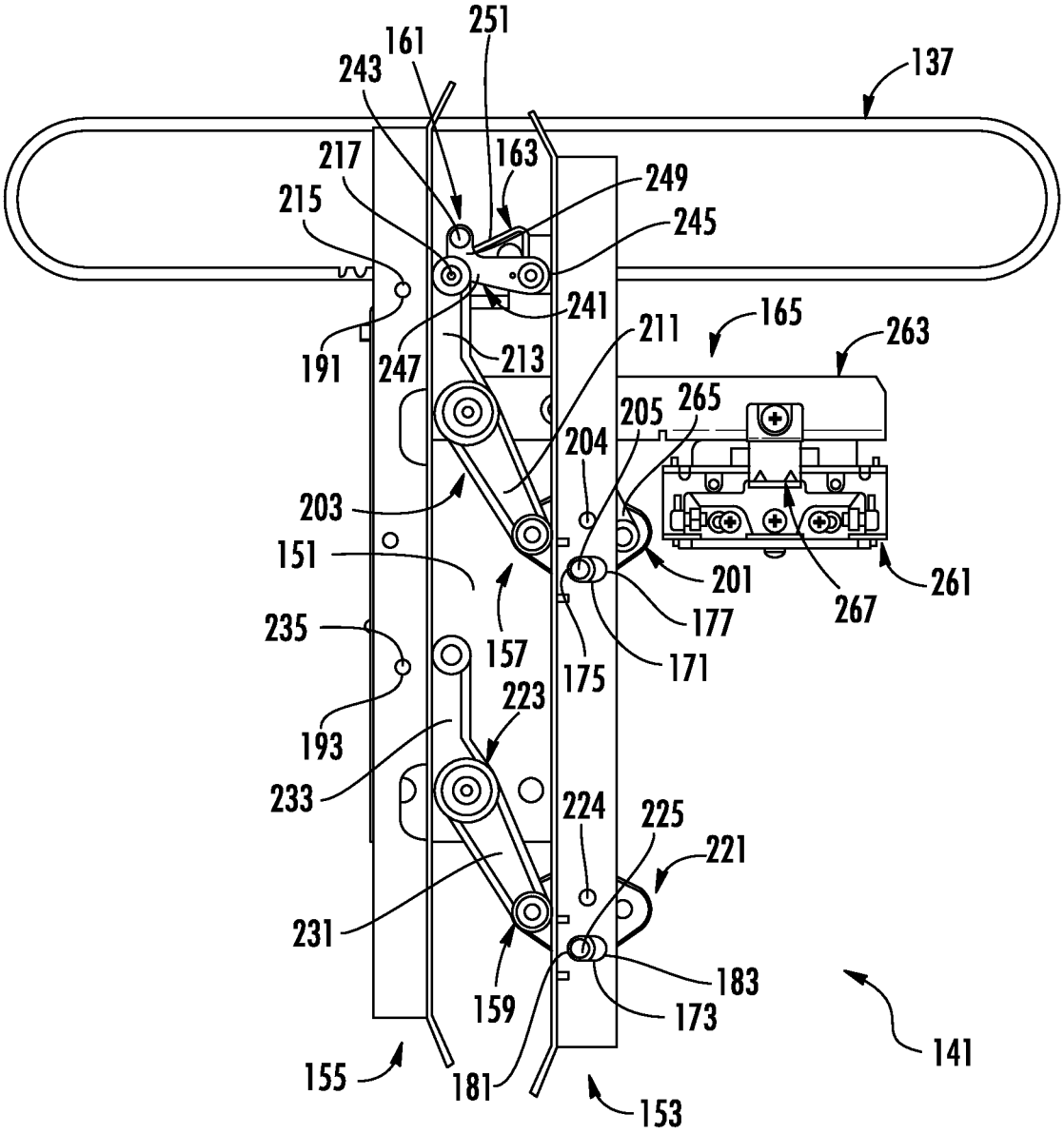
FIG. 7 is a perspective view of the car door interlock spaced apart from the interlock rollers and in a locked position to inhibit the elevator car doors from moving towards the open position.
Figure 8:
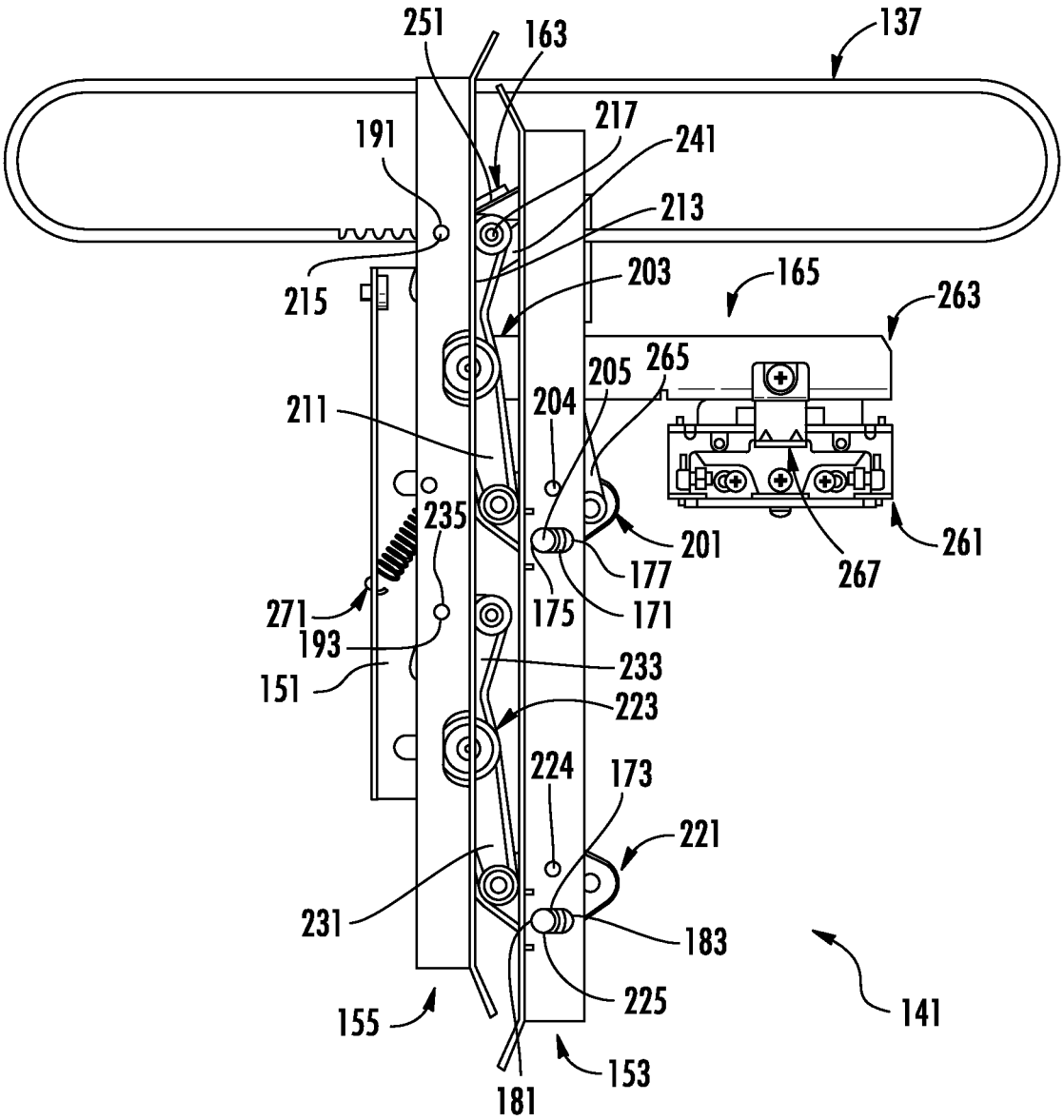
FIG. 8 is a perspective view of the car door interlock spaced apart from the interlock rollers and in the locked position inhibiting the elevator car doors from moving towards the open position.

Referring to FIGS. 7 and 8, should the elevator car 103 be located between landings 125 either while in operation or due to loss of power, the first interlock roller 273 may be spaced apart from the first sensing vane 153 and the second interlock roller 275 may be spaced apart from the second sensing vane 155. The first pin 205 of the first intermediate link 201 is disposed proximate the first slot first end 175 and the second pin 225 of the second intermediate link 221 is disposed proximate the second slot first end 181, while the interlock rollers are spaced apart from the first sensing vane 153 and the second sensing vane 155, as shown in FIG. 7.

The first intermediate link 201 is inhibited from pivoting about the first pin 205 while the first pin 205 of the first intermediate link 201 is disposed proximate the first slot first end 175. The second intermediate link 221 is inhibited from pivoting about the second pin 225 while the second pin 225 of the second intermediate link 221 is disposed proximate the second slot first end 181. The inhibiting of pivoting of the first intermediate link 201 inhibits the latch link 265 from pivoting such that the door latch 263 is inhibited from disengaging from the lock member 261. Therefore, responsive to an attempt to move the elevator car door 131 between the door closed position and the door open position, the pawl 241, the first link 203 and the second link 223 pivot to move the second sensing vane 155 relative to the first sensing vane 153 and the baseplate 151, such that the door latch 263 is inhibited from moving away from the lock member 261, as shown in FIG. 8.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator car door interlock, comprising:

a baseplate;

a first sensing vane;

a second sensing vane spaced from the first sensing vane by a gap;

a first link assembly, comprising:

a first intermediate link movably connected to the first sensing vane, and a first link pivotally connected to the baseplate, the first link having a first link first arm pivotally connected to the first intermediate link, and a first link second arm having a first link first connection that is pivotally connected to the second sensing vane; and a latch assembly, comprising:

a door latch pivotally connected to the baseplate and arranged to selectively engage a lock member, and a latch link extending between and pivotally connected to the door latch and the first intermediate link;

wherein responsive to a first interlock roller engaging an outside surface of the first sensing vane opposite the gap and a second interlock roller engaging an outside surface of the second sensing vane opposite the gap, the first intermediate link moves relative to the first sensing vane, such that the latch link moves the door latch to disengage from the lock member to enable an elevator car door to move between a door closed position and a door open position;

wherein the first sensing vane includes a closed first slot having a first slot first end and first slot second end;

wherein the first intermediate link includes a pivot pin that extends into the first slot and a second pivot that extends into the first vane;

wherein responsive to operation of a drive mechanism that is drivably connected to a first link second end, while an interlock roller engages at least one of the first vane and the second vane, the first vane moves, relative to the baseplate, towards the second vane and the pivot pin moves from the first slot first end towards the first slot second end.

2. The elevator car door interlock of claim 1, further comprising:

a pawl having a first pawl end pivotally connected to the baseplate and a second pawl end pivotally connected to a first link second connection of the first link.

3. The elevator car door interlock of claim 2, further comprising:

a pawl guide defining a ramp that is disposed proximate an end of the baseplate.

4. The elevator car door interlock of claim 3, wherein a rod extends from a pawl arm that is disposed proximate the second pawl end.

5. The elevator car door interlock of claim 4, wherein responsive to the car door moving from the open position towards the closed position, the rod rides along the ramp and the latch link moves to engage the lock member to inhibit the car door from moving away from the closed position.

6. The elevator car door interlock of claim 1, wherein responsive to the elevator car door moving between the door open position and the door closed position, the first link pivots to move at least one of the first sensing vane and the second sensing vane relative to the baseplate.

7. The elevator car door interlock of claim 1, further comprising a biasing member extending between the baseplate and at least one of the lock member and the door latch.

8. An elevator car door interlock, comprising:

a baseplate;

a first sensing vane;

a second sensing vane;

a first link assembly, comprising:

a first intermediate link movably connected to the first sensing vane, and a first link pivotally connected to the baseplate, the first link having a first link first arm pivotally connected to the first intermediate link, and a first link second arm having a first link first connection that is pivotally connected to the second sensing vane; and a latch assembly, comprising:

a door latch pivotally connected to the baseplate and arranged to selectively engage a lock member, a latch link extending between and pivotally connected to the door latch and the first intermediate link;

a biasing member extending between the baseplate and the second sensing vane;

wherein responsive to a first interlock roller engaging the first sensing vane and a second interlock roller engaging the second sensing vane, the biasing member moves the second sensing vane relative to the baseplate and moves the door latch to disengage from the lock member to enable an elevator car door to move between a door open position and a door closed position;

wherein the first sensing vane includes a closed first slot having a first slot first end and first slot second end;

wherein the first intermediate link includes a pivot pin that extends into the first slot and a second pivot that extends into the first vane;

wherein responsive to operation of a drive mechanism that is drivably connected to a first link second end, while an interlock roller engages at least one of the first vane and the second vane, the first vane moves, relative to the baseplate, towards the second vane and the pivot pin moves from the first slot first end towards the first slot second end.

9. The elevator car door interlock of claim 8 further comprising:

a pawl having a first pawl end pivotally connected to the baseplate and a second pawl end pivotally connected to a first link second connection of the first link.

10. The elevator car door interlock of claim 8, further comprising:

a second link assembly pivotally connected to the baseplate and spaced apart from the first link assembly, the second link assembly, comprising:

a second intermediate link movably connected to the first sensing vane, and a second link pivotally connected to the baseplate, the second link having a second link first arm pivotally connected to the second intermediate link, and a second link second arm having a second link first connection that is pivotally connected to the second sensing vane.

11. The elevator car door interlock of claim 10, wherein the first sensing vane defines a second slot that receives a second pin of the second intermediate link.

12. An elevator car door interlock, comprising:

a baseplate;

a first sensing vane;

a second sensing vane;

a first link assembly, comprising:

a first intermediate link movably connected to the first sensing vane, and a first link pivotally connected to the baseplate, the first link having a first link first arm pivotally connected to the first intermediate link, and a first link second arm having a first link first connection that is pivotally connected to the second sensing vane; and a latch assembly, comprising:

a door latch pivotally connected to the baseplate and arranged to selectively engage a lock member, a latch link extending between and pivotally connected to the door latch and the first intermediate link;

a biasing member extending between the baseplate and the second sensing vane;

wherein responsive to a first interlock roller engaging the first sensing vane and a second interlock roller engaging the second sensing vane, the biasing member moves the second sensing vane relative to the baseplate and moves the door latch to disengage from the lock member to enable an elevator car door to move between a door open position and a door closed position;

wherein the first sensing vane defines a first slot that receives a first pin of the first intermediate link;

a second link assembly pivotally connected to the baseplate and spaced apart from the first link assembly, the second link assembly, comprising:

a second intermediate link movably connected to the first sensing vane, and a second link pivotally connected to the baseplate, the second link having a second link first arm pivotally connected to the second intermediate link, and a second link second arm having a second link first connection that is pivotally connected to the second sensing vane;

wherein responsive to an attempt to move an elevator car door between a door closed position and a door open position while a first interlock roller being spaced apart from the first sensing vane and a second interlock roller being spaced apart from the second sensing vane, the pawl pivots relative to the baseplate, the first link and the second link move the second sensing vane relative to the first sensing vane, and the door latch is inhibited from disengaging from the lock member.

13. An elevator car door interlock comprising:

a first link assembly, comprising:

a first intermediate link movably connected to a first sensing vane, and a first link pivotally connected to a baseplate, the first link having a first link first arm pivotally connected to the first intermediate link, and a first link second arm having a first link first connection that is pivotally connected to a second sensing vane; and a latch assembly, comprising:

a lock member, a door latch pivotally connected to the baseplate and arranged to selectively engage the lock member, a latch link extending between and pivotally connected to the door latch and the first intermediate link;

a pawl having a first pawl end pivotally connected to the baseplate and a second pawl end pivotally connected to a first link second connection of the first link;

wherein the first sensing vane defines a closed first slot that receives a first pin of the first intermediate link;

wherein responsive to a first interlock roller engaging the first sensing vane and a second interlock roller engaging the second sensing vane, the first pin of the first intermediate link moves between a first slot first end and a first slot second end of the closed first slot.

14. The elevator car door interlock of claim 13, wherein responsive to the first interlock roller engaging the first sensing vane and the second interlock roller engaging the second sensing vane, a second pin of the second intermediate link moves between a second slot first end and a second slot second end.

15. The elevator car door interlock of claim 13, further comprising:

a belt drive drivably connected to the first link through a pin.

16. The elevator car door interlock of claim 15, wherein responsive to a first interlock roller engaging the first sensing vane and a second interlock roller engaging the second sensing vane and responsive to the belt drive pivoting the first link, the first intermediate link moves relative to the first sensing vane, such that the latch link moves the door latch to disengage from the lock member to enable an elevator car door to move between a door closed position and a door open position.

* * * * *